United States Patent [19]

Gertsch et al.

[11] 4,394,835

[45] Jul. 26, 1983

[54] DRIVE FOR ROTARY-ROLLER OFFSET PRINTING MACHINES

[76] Inventors: Peter Gertsch; Robert Imhof, both of Bern, Switzerland

[21] Appl. No.: 333,683

[22] Filed: Dec. 23, 1981

Related U.S. Application Data

[63] Continuation-in-part of Ser. No. 308,484, Oct. 5, 1981, abandoned, which is a continuation of Ser. No. 113,376, Jan. 18, 1980, abandoned.

[30] Foreign Application Priority Data

Jan. 22, 1979 [SE] Sweden ..... 7900573

[51] Int. Cl.[3] ..... B41F 5/18; B41F 13/00

[52] U.S. Cl. ..... 101/177; 101/178; 101/220

[58] Field of Search ..... 101/136, 137, 138, 139, 101/140, 141, 142–145, 177, 178, 179, 180, 181, 182, 183–185, 220, 221

[56] References Cited

U.S. PATENT DOCUMENTS

| | | | |
|---|---|---|---|
| 3,329,086 | 7/1967 | Pullen | 101/179 |
| 3,505,953 | 4/1970 | Germann | 101/248 |

FOREIGN PATENT DOCUMENTS

| | | | |
|---|---|---|---|
| 2024482 | 12/1971 | Fed. Rep. of Germany | 101/180 |
| 2337259 | 6/1974 | Fed. Rep. of Germany | 101/177 |
| 1611300 | 11/1974 | Fed. Rep. of Germany | 101/177 |
| 936710 | 9/1963 | United Kingdom . | |

*Primary Examiner*—J. Reed Fisher

[57] ABSTRACT

The disclosure concerns a nine-roll or ten-roll printing mechanism, in which the directions of rotation of the rolls have to be reversed individually according to a printing program. The driving connection to the plate rolls is effected through two oppositely rotating impression roll gears which are rotatably mounted on the axle of the impression roll. The impression roll gears can be coupled to the axle of the impression roll by means of remotely operable couplings. A sliding gear is associated with each plate roll. The sliding gear selectively engages one or the other impression roll gear. An indexing wheel corresponds to each sliding gear and is mounted slidably on the plate roll axle. The width of the sliding gears is selected so that an idling setting is excluded. Each plate roll is connected with its associated offset roll by means of a rotation-secure driving connection.

14 Claims, 10 Drawing Figures

DRIVE FOR ROTARY-ROLLER OFFSET PRINTING MACHINES

RELATED APPLICATIONS

This is a continuation-in-part application of Ser. No. 308,484, filed Oct. 5, 1981 now abandoned, which is a continuation application of Ser. No. 113,376, filed Jan. 18, 1980, now abandoned.

BACKGROUND OF THE INVENTION

This invention relates to a drive for a web fed rotary-roller offset printing machine with nine-roll or ten-roll printing mechanisms for optional impression-blanket or offset-offset operation and arbitrary reversibility of the individual inking rolls and plate/impression roll pairs.

Printing units of this kind are known from German Patent Specification No. 23 37 259 and U.S. Pat. No. 3,329,086. In order to make possible the establishment of driving connections for the various paper-guide and pressure modes, up to six special couplings must be actuated and up to four counter-shaft gear wheels must be brought into or out of engagement.

This type of drive construction involves a considerable gearing expenditure. In addition, the gear wheels located on a side wall of the main frame of the machine have a detrimental effect on the noise level on the operator's side of the machine.

Depending on the printing program, the drive is effected either from the plate roll to the blanket roll or inversely. Owing to the fact that the drive may be selectively in either direction, an adaptation of the diameter ratio of the rolls to the driving sequence for purposes of disturbance-free run-off is not possible. The fact that the roll pairs are freely adjustable relative to each other makes it necessary that the position of each roll pair must be individually detected if the switching or change-over operations are to be automated.

In prior printing units of this type, blanket rolls or cylinders are mounted in such a way that they can be applied either against the impression cylinder or else mutually in pairs against each other. By this long-known possibility of adjustment, one moving paper web can be printed in different variations, i.e. for instance, both sides in two colors, one side in one color and the other side in three colors or one side in four colors. Similarly, it is possible to print two paper webs in various combinations. The direction of rotation of each cylinder must be reversible.

The subject of the present invention is the drive of the cylinders for a printing unit of the type described above.

Drives in which the drive sequence changes depending on the cylinder position and the direction of rotation are known. The drive can be from the plate cylinder to the blanket cylinder and from there to the next blanket cylinder and the next plate cylinder. Also, the drive sequence for the first pair of cylinders can be reversed.

SUMMARY OF THE INVENTION

The purpose of the invention is to provide a drive of the type above-mentioned which avoids the above-indicated drawbacks, and which drive makes possible a problem-free and automatic reversal of the driving connections.

According to the invention, this object is achieved by having the axle of an impression roll carry two cylinder gears rotatably mounted thereon. Connection of the axle of the impression roll to the cylinder gears is obtained by means of remotely controllable couplings. The inner cylinder gear engages the coupling in a counter-shaft wheel and the outer cylinder gear engages the coupling in an intermediate wheel meshing with the counter-shaft wheel. On the axle of each plate roll, an indexing wheel is slidably fitted which, through a sliding gear mounted slidably and rotatably on a bolt carried by a machine wall, is in optional selective engagement with one of the two cylinder gears. The sliding course and the width of the sliding gear are so determined that an idling setting is excluded. Each plate roll is rotation-secured to its associated offset roll by means of a wheel pair.

A characteristic feature of the present invention resides in formation of a drive in such a manner that:

1. it is very simple and is supported on one side wall of the main frame of the printing unit;
2. the drive always takes place from the plate cylinder to the blanket cylinder, in every direction of rotation, and
3. it is of such a nature that the drive gears of the pairs of cylinders can never be brought out of engagement.

The invention, therefore, refers to the drive per se, and not to individual printing elements since the latter are already known.

BRIEF DESCRIPTION OF THE DRAWINGS

The foregoing and other objects of this invention will become apparent in the following description and drawings in which.

DESCRIPTION OF THE PREFERRED EMBODIMENTS

Figure 1:
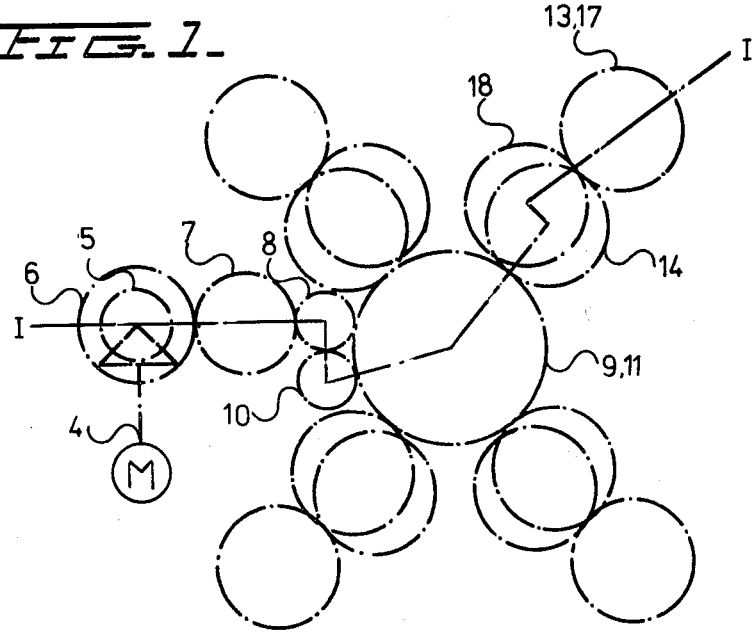
FIG. 1 shows the gear-connections in a nine-roll printing mechanism, schematically.
Figure 2:
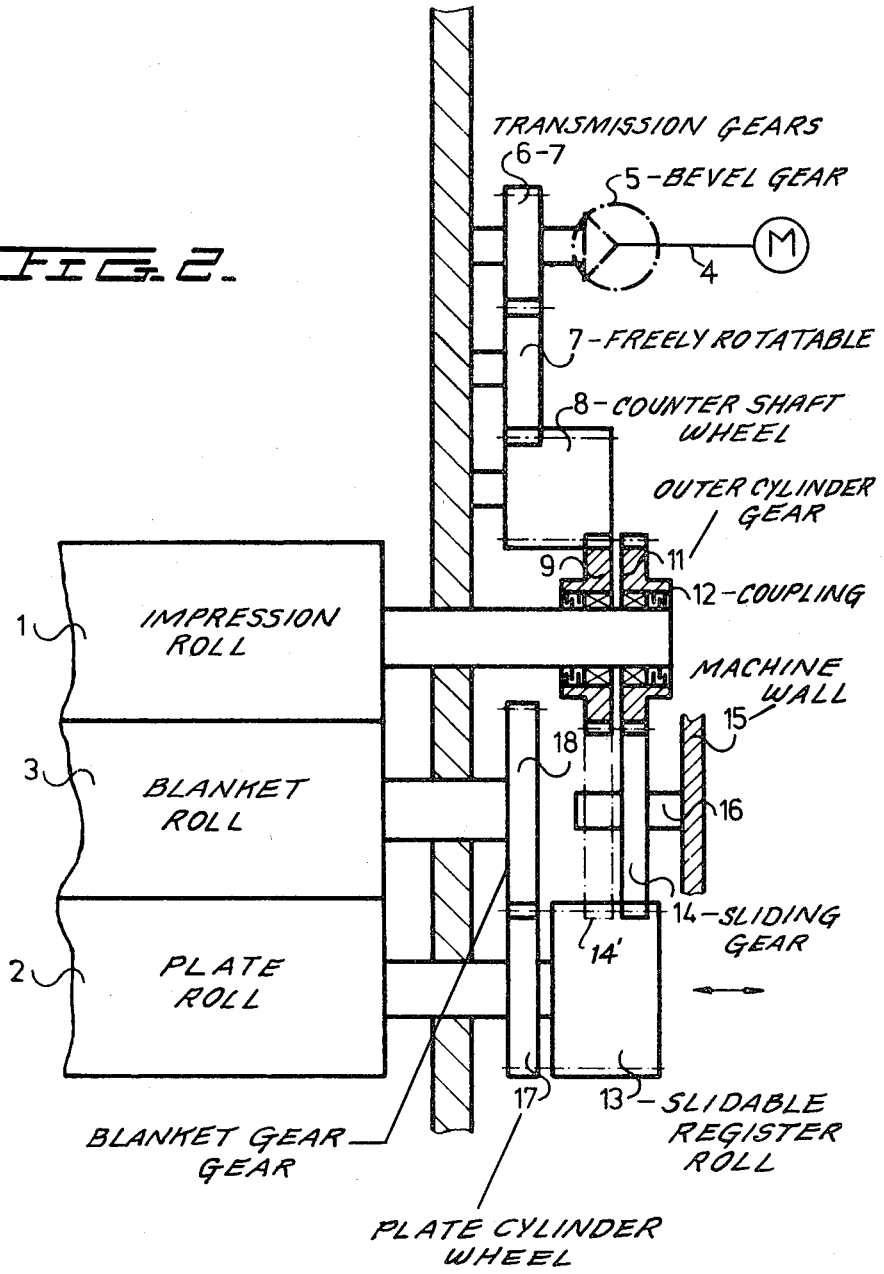
FIG. 2 is a section taken along the line I—I in FIG. 1.

In the nine-roll printing mechanism schematically illustrated in FIGS. 1 and 2, an impression roll 1 has associated therewith in a known manner four roll pairs each consisting of a plate roll 2 and an offset roll 3. Depending upon the printing program, the offset rolls 3 can be set at will to apply to the impression roll 1 or, independently of each other, to the offset rolls of the upper roll pairs and/or the offset rolls of the lower roll pairs relative to each other. These various settings imply different rotational possibilities within the printing mechanism.

The driving of the rolls is effected by the machine shaft 4 through a bevel gear pair 5 to a transmission gear set 6, 7 which is in operative connection with the countershaft wheel 8. The countershaft wheel 8 engages or is operatively connected, on one hand, into the inner cylinder gear 9 and, on the other hand, into an intermediate gear 10, which meshes with the outer cylinder gear 11. The two cylinder gears 9, 11 which, during operation, necessarily rotate in opposite directions, are mounted freely rotatably on the axle of impression roll 1 and are connected to the axle through remotely controllable couplings 12, e.g. electromagnetic couplings controlled by remote controls 12*a*. Depending on the desired direction of rotation of the impression cylinder 1, one or the other coupling will be actuated by means of a suitable, not illustrated, control means and the corresponding cylinder gear will thereby be made fast for rotation with the axle of the impression roll 1. In a purely offset or blanket roll operation, both cylinder gears 9, 11 rotate idly on the axle but, if the desired run of the paper requires, each gear can be coupled in arbitrarily.

An indexing wheel 13 is fixed on the axle of each plate cylinder 2. It is fixed. It is secured against rotation with respect to its axle but is slidable with respect to the axle. The wheel 13 continuously engages a sliding gear 14, which is rotatably mounted on a bolt 16 that is fast in the main frame wall 15. By means of a known sliding device 14*a*, the gear 14 can be shifted axially into engagement alternately with one of the cylinder gears 9, 11. The width of the sliding gear 14 is greater than the distance between the two cylinder gears 9, 11 and its slide course on bolt 6 is so limited, that an idling setting is excluded, i.e., the sliding gear 14 is continuously in engagement with one or the other cylinder gears 9, 11 and, during changeover, with both of the latter for a brief period.

The drive of the offset cylinder 3 is effected by means of the plate cylinder gear 17 and the offset roll cylinder gear 18 which is in engagement therewith, owing to which each offset roll 3 automatically follows a possibly required circumferential adjustment of the associated plate roll 2.

The position or the embodiment of the individual offset roll cylinder gears 18 is so selected that they do not come into contact with each other during blanket roll to blanket roll operation.

Preferably, all gear wheels described above are helically geared.

As illustrated in the drawings, all of the various gears and associated elements are disposed on the drive side of the machine.

Figure 3:
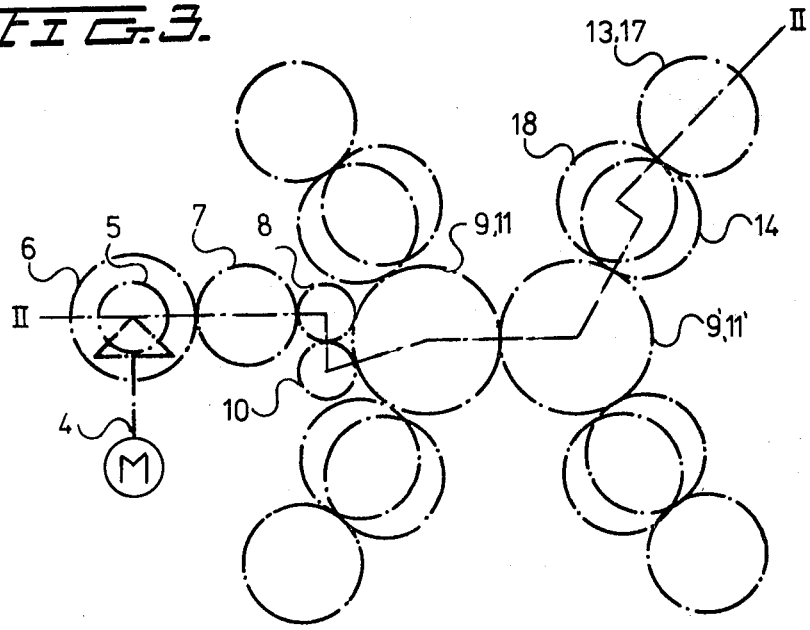
FIG. 3 shows the gear connections in a ten-roll printing mechanism, schematically.
Figure 4:
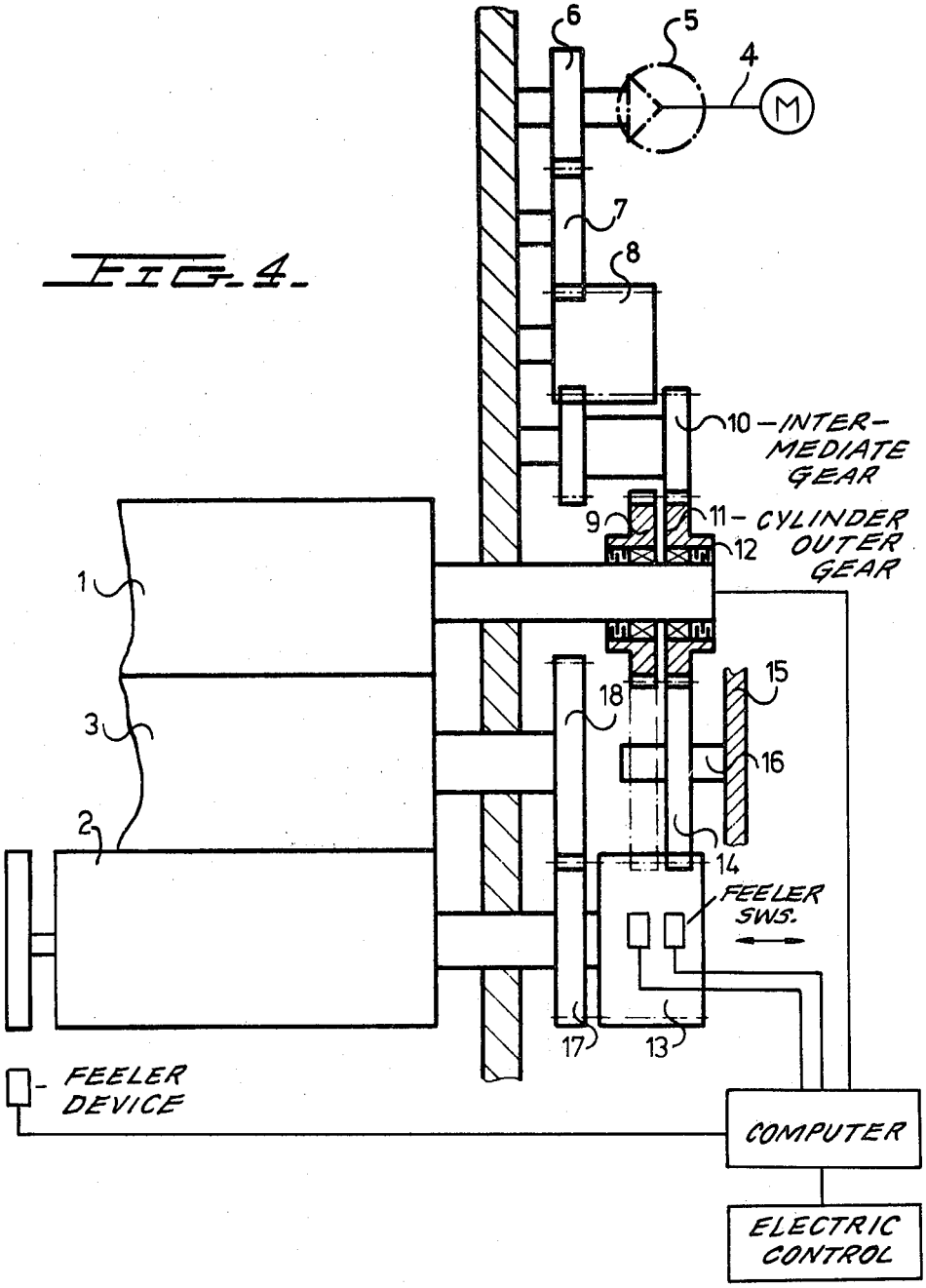
FIG. 4 is a section taken along the line II—II in FIG. 3.

The ten-roll printing mechanism illustrated in FIGS. 3 and 4 differs from the nine-roll printing mechanism in that it has two impression cylinders 1, 1', whose cylinder gears 9, 11, 9', 11' which can be coupled with the inking roll axles are continuously in engagement in pairs, and that with the cylinder gear set of each impression roll there are associated the driving connections of two plate rolls each.

While it is known that the blanket cylinders can be mounted so that they can be applied either against each other or against an impression cylinder, the present invention is directed to improvements which make the operation more certain and the adjustments in operation more readily available. The inner cylinder gear 9 is driven from the counter gear 7 by means of the counter gear 8 while the drive of the outer cylinder gear 11 is effected from the counter gear 7 by means of the counter gear 8 and the intermediate gear 10. The cylinder gears 9, 11 therefore turn in opposite directions. The counter gear 8 is a tooth gear and engages simultaneously both with the counter gear 7 and the inner cylinder gear 9 as well as the inner gear ring 10' of the intermediate gear 10.

In the embodiment of the present invention, however, neither of the two couplings 12 is engaged and therefore the cylinder gears 9, 11 turn freely on the shaft of the impression cylinder 1. However, if the printing process is operative in accordance with FIG. 1, then the impression cylinder 1 must be driven even in case of pure rubber-to-rubber or blanket-to-blanket operation, that is, one or the other coupling, depending on whether the web of paper is conducted clockwise or counter-clockwise around the impression cylinder must be connected.

The fact that the impression cylinder must be capable of being driven clockwise and counter-clockwise follows from the fact that the inner cyliner gear 9 is driven by the counter gear 7 while the outer cylinder gear 11 is driven from the counter gear 7 by the counter gear 8 and the intermediate gear 10 and the cylinder gears 9, 11 therefore turn in opposite directions.

The register gear, as now will be obvious, is that gear wheel by which the peripheral register, that is, the angular position of the plate cylinder within the drive system, can be changed. This change is necessary if, for instance, in the case of multicolor printing, the print of the first color does not register accurately with the print of the second color for any reason. This provides a running register.

Since in the present invention all the drive gears are helical, the running register gear 13 is displaced axially with respect to the sliding gear 14. Then the position of the printing changes in the direction of travel of the web of the paper. The blanket cylinder 3 operates simultaneously with the plate cylinder 2.

In a printing unit of this type, it is necessary that the directions of rotation of the plate/blanket cylinder pairs and the direction of rotation of the impression cylinder can be changed in accordance with the desired printing program independently of each other and independently of the main drive. This has already been explained and is preliminary to the following.

The known drives for printing units of this type are developed in such manner that the drive sequence plate cylinder to blanket cylinder changes to rubber cylinder to plate cylinder, depending on the printing program. The essential element of the present invention is the creation of a type of drive in which the drive takes place in every phase of use from the plate cylinder to the rubber blanket cylinder while, at the same time, avoiding all of the other defects which have arisen in the prior art.

The physical construction of the present drive for a nine-cylinder printing unit is shown in FIGS. 5, 6, 7, 8 and 9. These Figures are elaborations of FIGS. 1, 2, 3 and 4 and require no specific additional description owing to the fact that the structures are identical as shown in their actual form, taken from shop drawings, but follow exactly the schematic drawings of FIGS. 1 through 4. It should be noted, however, that in the drawings of FIGS. 5 through 9, the countershaft wheel 7 of original FIG. 1 is arranged as a freely rotatable pair of wheels behind the countershaft wheel 8 and the intermediate wheel 9, respectively, which, however, in no way changes the inventive concept. This can be determined much more readily by a comparison of schematic FIG. 9 with the original FIGS. 1 through 7.

Figure 9:
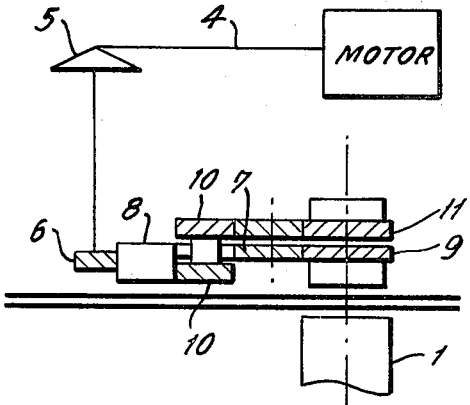
FIG. 9 is a schematic view showing the method of controlling the operations of the structures of FIGS. 2, 4 and 5 through 8.

Thus, FIG. 9 shows diagrammatically the drive of the printing unit from the motor to the impression cylinder.

While FIG. 9 is in part schematic, it is more closely related to the conformation of the original elements and since FIG. 9 is thus based on the schematic showings of FIGS. 1 to 4 as well as FIG. 10 (which has a modification hereinafter described), the same reference numerals have been applied.

Figure 5:
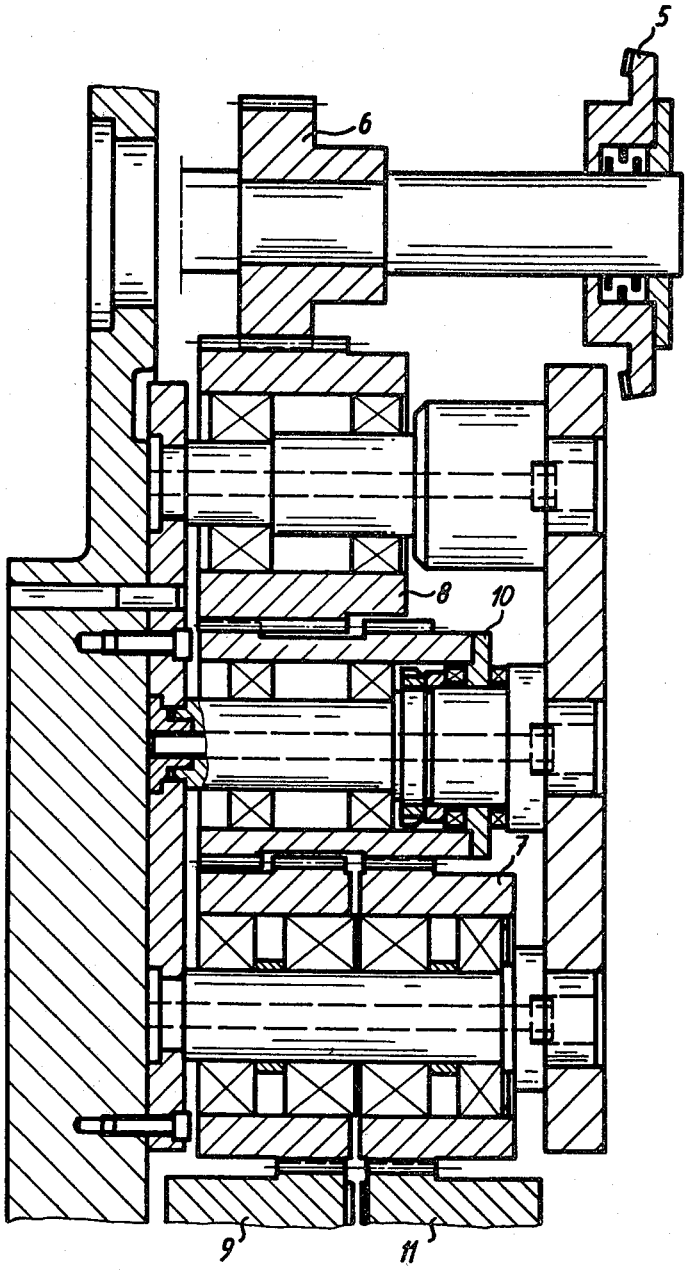
FIG. 5 is a partial cross-sectional view along line 5—5 of FIG. 10, showing the upper section of the drive in cross-sectional arrangement rather merely a diagrammatic form.
Figure 10:
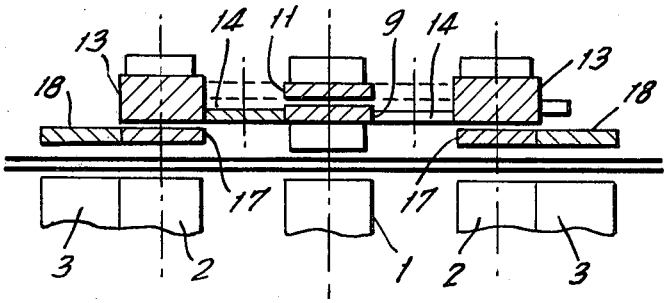
FIG. 10 is also a schematic view showing a variation of the structure of FIG. 3.
Figure 10:
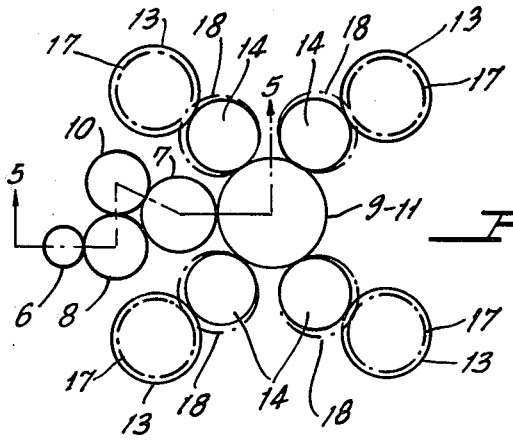

FIG. 5 is a basic supplement to the above-mentioned diagrammatic drawing of FIGS. 1 to 4, as modified by the alternate placement of the roller 7 of FIG. 10. The drive sequence is identical with that described and the same reference numbers have been applied. The drive sequence extends on the one hand from wheel 1 via wheel 2 to double wheel 3 to wheel 4 and on the other hand from wheel 1 via wheel 2 directly to wheel 4*a*. The two wheels 4 and 4*a* therefore turn in opposite directions.

Figure 6:
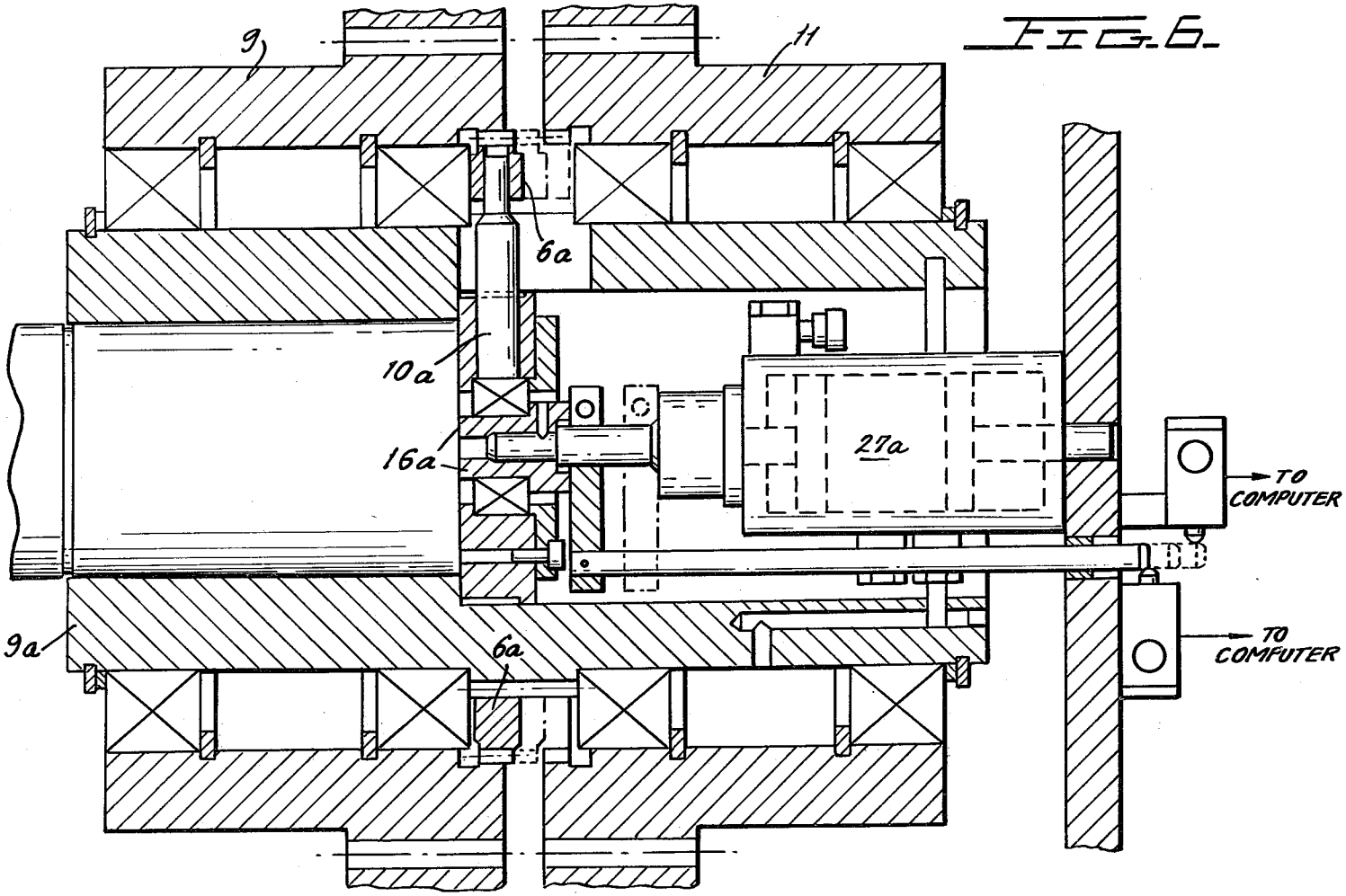
FIG. 6 is a cross-sectional view of part of the mechanism showing the actual optional coupling of the cylinder wheels with the impression cylinder and corresponds to the blank portion of FIGS. 2, 4 and 5.

FIG. 6 is directed to the showing of the coupling for the optional coupling of the cylinder wheels with the impression cylinder. A coupling bushing 9*a* is fixed for rotation on the journal of the impression cylinder. On the central portion of this coupling bushing 9*a*, a coupling ring 6*a* is mounted fixed for rotation but slidable axially and it is provided with an outer section of gear teeth. This outer gear toothed arrangement corresponds to the inner gear teeth in the cylinder wheels 9 and 11 which turn in opposite directions. The coupling ring 6*a* is coupled via a driver 10*a* and the bearing head 16*a* of the driver 10*a* with the piston rod of a double acting cylinder 27*a*. Cylinder 27*a* is remotely controlled. By means of this remotely controllable cylinder, the coupling ring 6*a* can alternatively be coupled with the cylinder wheel 9 or the cylinder wheel 11 or else brought into an intermediate idle position.

While this mechanical coupling is shown in order to provide alternate means of coupling or an idle position, it will be obvious from the state of the art that an electromagnetic coupling can be used to provide the alternate coupling or the idle position.

Figure 7:
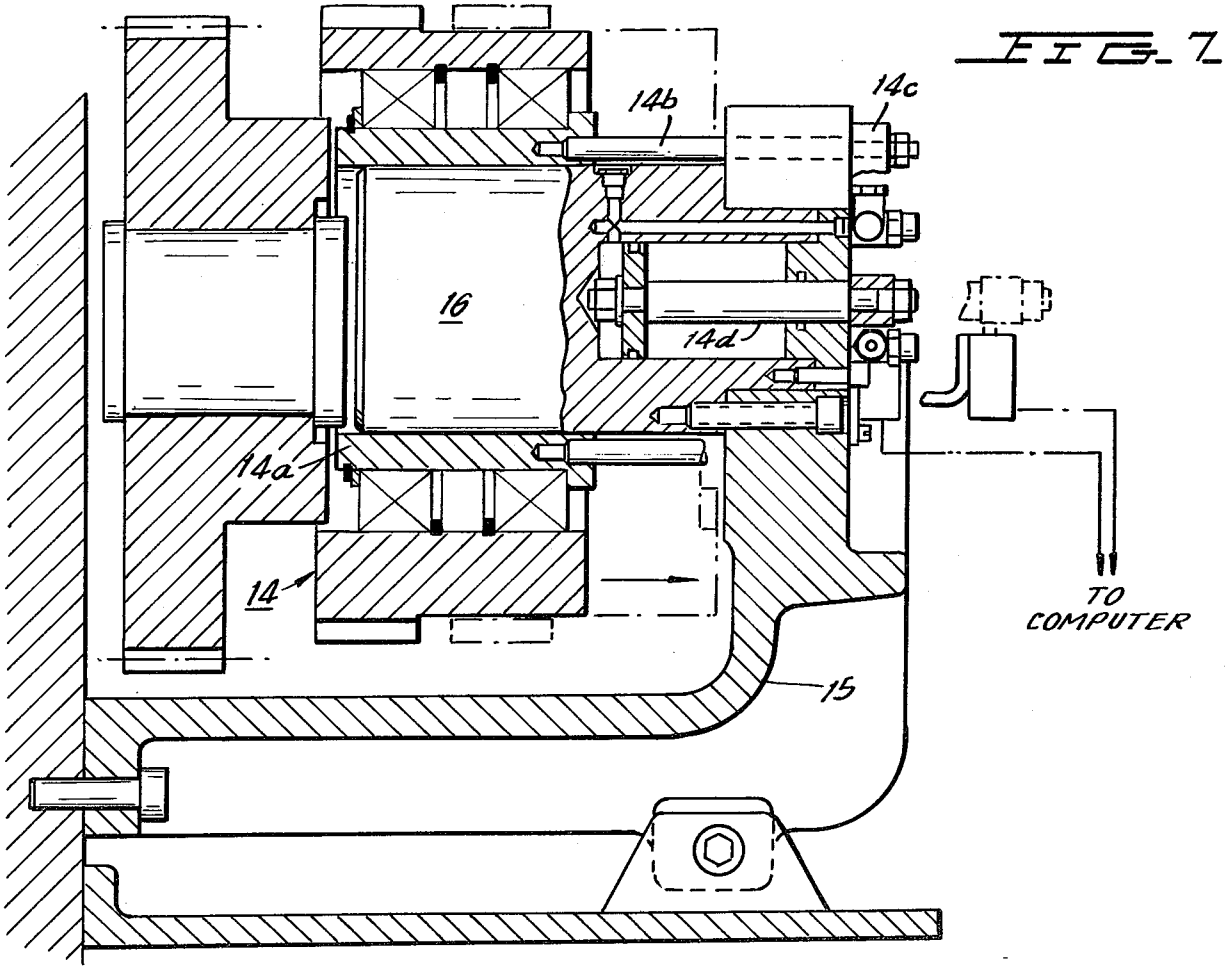
FIG. 7 is a cross-sectional view corresponding to the middle portion of FIGS. 2 and 4 showing the mounting and actuation of the slide wheel or portion of the transmission.

FIG. 7 shows the mounting and actuation of the slide wheel 14. The slide wheel 14 is mounted in a freely rotatable manner on the slided bushing 14*a* which is connected to the piston rod of a pressure cylinder 14*b* by means of the stay bolt 14*b* and a yoke 14*c* shown in dotted lines. In this way a remotely controlable displacement of the slide wheel 14 into the alternative positions is assured.

Figure 8:
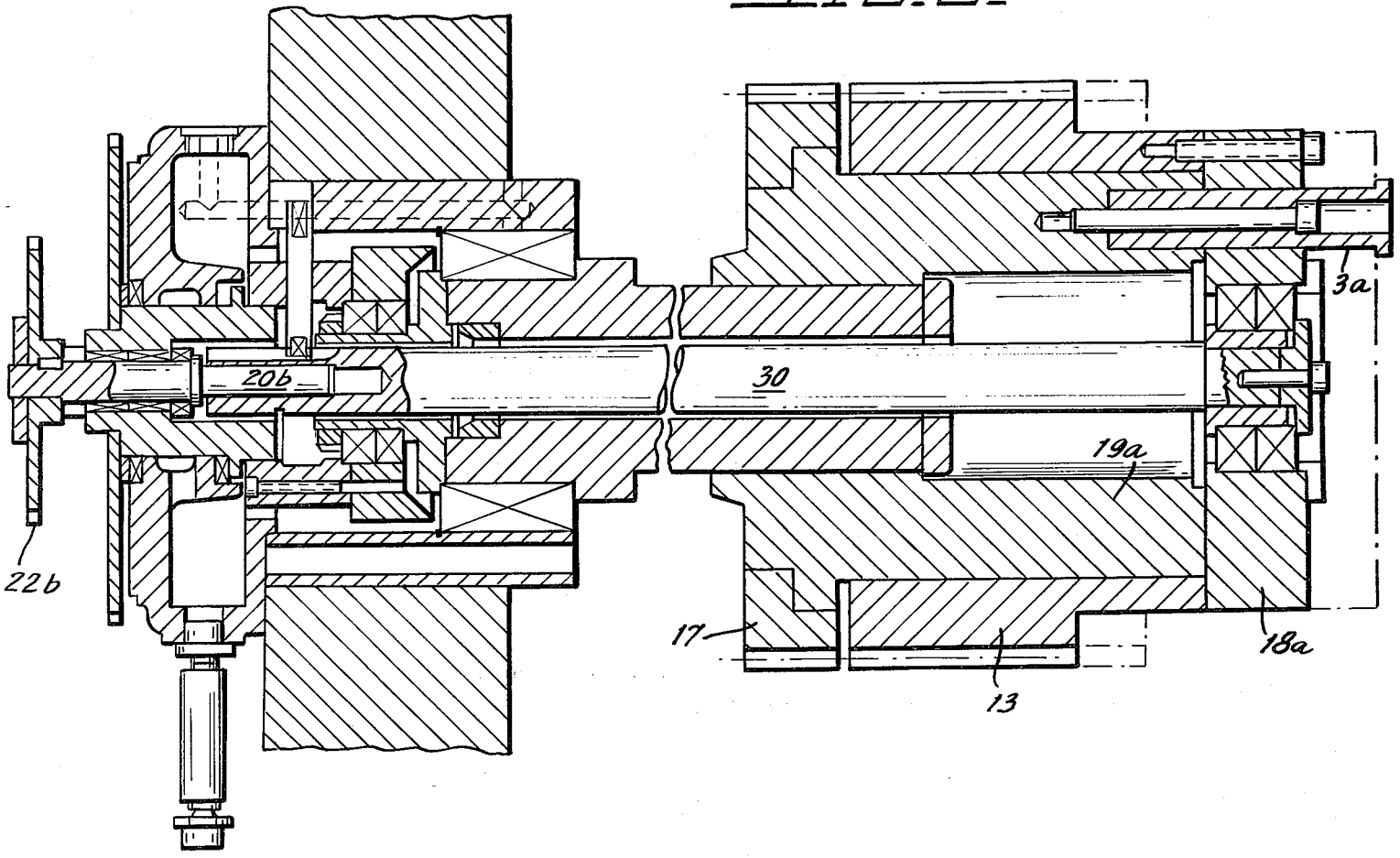
FIG. 8 is a cross-sectional view corresponding to the lower portions of FIGS. 2 and 4 showing the method of actuating the register wheel of the present structure.

FIG. 8 is directed to the actuation of the running register wheel 13. Carrier bushing 19*a* is connected fixed for rotation to the journal pin of the plate cylinder 2, the plate cylinder wheel 17 being fastened to said bushing. The running register wheel is also mounted for axial displacement on the carrier bushing 19*a* and is firmly connected to a flange 18*a* which transmits the rotation of the running register wheel 13 by means of a driver 3*a* to the carrier bushing 19*a* and thus to the plate cylinder. In order to provide continuous displacement of the running register wheel 13, a rod 30 is rotatably mounted on the flange 18*a* passing through the axial of the plate cylinder 2, which axle is developed as a hollow shaft to the operating side of the machine. By means of an adjustment spindle 20*b* which engages in a threaded hole arranged on its end and can be driven by a gear 22*b*, the rod 30 and thus the running register wheel 13 can be shifted axially as required.

A feeler device is arranged on the plate cylinder 2, said device (see FIGS. 6 and 7) being electrically connected to a computer to which the feeler switches are connected. In its turn, the computer is connected with an electric control of the main drive. In this way, it is possible to effect all switch prosesses for the different printing programs completely automatically. However, it should be pointed out that the invention here is directed to the development of the drive which permits the switching between the alternative systems and the particular relationship of the feeler device, the computer and the main drive while indicated for the sake of completeness is not part of the present invention. It also should be pointed out that the invention is shown primarily in FIGS. 1, 2, 3, 4 and the variation of FIG. 10. The particular conformation of the gears in order to carry out the invention shown schematically in FIGS. 1 through 4 and 10 is essentially a matter of choice and the conformation of the gears has been included in order to provide a fuller disclosure, which disclosure is believed to be useful to those skilled in the art but not absolutely essential. The FIG. 10 diagrammatic showing provides an alternate position, already described for drive member 7.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. Drive means for a rotary-roller offset printing machine, with arbitrary reversibility of the rotation direction of impression roll means and of plate rolls of the machine, the drive means comprising:

impression roll means comprising an impression roll; a plurality of separate plate rolls for communicating with the impression roll means; a respective offset roll for each plate roll and being rotation-secured to the associated plate roll; each of the offset rolls being settable to be applied to the impression roll means for rotating together therewith;

two impression roll gears, each independently and rotatably connected with the impression roll means; coupling means for individually coupling one or the other of the two impression roll gears to the impression roll means for rotating therewith;

a drive for the two impression roll gears;

a countershaft wheel connected with the drive for being rotated thereby; the one impression roll gear engaging the countershaft wheel for being driven thereby; an intermediate wheel connected with the countershaft wheel for being driven thereby to rotate in the direction counter to the direction of rotation of the countershaft wheel; the other impression roll gear engaging the intermediate wheel for being driven thereby; whereby depending upon which of the two impression roll gears is connected with the impression roll means, the direction of rotation of the impression roll means is determined;

an axle drivingly connected with the plate roll; an indexing wheel at that axle and rotatable therewith;

a sliding gear rotatably mounted for engaging and for rotating the indexing wheel and also being axially slidable for selectively meshing with the one or the other impression roll gear, whereby the direction of rotation of the plate roll is determined by whichever one of the impression roll gears is engaged by the sliding gear.

2. The drive means for a rotary-roller offset printing machine of claim 1, wherein the impression roll has an axis and the two impression roll gears are rotatably mounted thereon; said coupling means selectively coupling or decoupling each of said impression roll gears to said impression roll means axle.

3. The drive means for a rotary-roller offset printing machine of either of claims 1 or 2, wherein said couplings for each said impression roll gears is remotely controllable.

4. The drive means for a rotary-roller offset printing machine of either of claims 1 or 2, wherein the axle drivingly connected with the plate roll is the axle of the plate roll; the indexing wheel being on the plate roll axle.

5. The drive means for a rotary-roller offset printing machine of claim 4, wherein the indexing wheel is slidably mounted on the axle of the plate roll.

6. The drive means for a rotary-roller offset printing machine of either of claims 1 or 2, further comprising a bolt on which the sliding gear is mounted for axial sliding.

7. The drive means for a rotary-roller offset printing machine of claim 4, further comprising means for axially sliding the sliding gear.

8. The drive means for a rotary-roller offset printing machine of claim 7, wherein the sliding gear is so shaped and the means for sliding the sliding gear is operable such that the sliding gear engages one of the two impression gears, and an idling setting of the sliding gear is prevented.

9. The drive means for a rotary-roller offset printing machine of claim 1, further comprising means for axially sliding the sliding gear; the sliding gear being so shaped and the means for sliding the sliding gear being operable such that the sliding gear engages one of the two impression gears and an idling setting of the sliding gear is prevented.

10. The drive means for a rotary-roller offset printing machine of claim 1, wherein the offset roll and the associated plate roll are rotation-secured by means of a wheel pair, with a respective wheel of the wheel pair being drivingly connected with the respective one of the offset roll and the plate roll.

11. The drive means for a rotary-roller offset printing machine of claim 1, wherein the impression roll means comprises a single impression roll.

12. The drive means for a rotary-roller offset printing machine of claim 1, wherein the impression roll means is comprised of two of the impression rolls; a plurality of seperate ones of the plate rolls communicating with each of the impression rolls; a respective one of the offset rolls being rotation-secured to the associated plate roll;

a respective set of two impression roll gears for each of the two impression rolls; each of the impression roll gears of each of the impression rolls being in meshing engagement with a respective one of the impression roll gears of the other impression roll.

13. The drive means for a rotary-roller offset printing machine of claim 1, wherein all gears are helically geared.

14. The drive means for a rotary-roller offset printing machine of claim 1, wherein the machine has a drive side at the side of the rolls and all of the gears are disposed on the drive side of the machine.

* * * * *

UNITED STATES PATENT AND TRADEMARK OFFICE

CERTIFICATE OF CORRECTION

PATENT NO. : 4,394,835
DATED : Jul. 26, 1983
INVENTOR(S) : Peter Gertsch; Robert Imhof It is certified that error appears in the above-identified patent and that said Letters Patent are hereby corrected as shown below:

Please insert on the cover sheet of this patent:

--[73] Assignee: Maschinenfabrik WIFAG, Bern Switzerland--

Signed and Sealed this

*Twenty-seventh* Day of *September 1983*

[SEAL]

*Attest:*

GERALD J. MOSSINGHOFF

*Attesting Officer* *Commissioner of Patents and Trademarks*